US005137066A

United States Patent [19]

Dimter

[11] Patent Number: 5,137,066

[45] Date of Patent: Aug. 11, 1992

[54] DOVETAIL JOINTING PRESS

[76] Inventor: Erwin Dimter, Rudolf-Diesel-Strasse 12, 7918 Illertissen, Fed. Rep. of Germany

[21] Appl. No.: 640,244

[22] Filed: Jan. 11, 1991

[30] Foreign Application Priority Data

Jan. 12, 1990 [DE] Fed. Rep. of Germany ..... 4000804
Nov. 7, 1990 [DE] Fed. Rep. of Germany ..... 4035423

[51] Int. Cl.[5] ..... B27F 1/00; B27C 9/00

[52] U.S. Cl. ..... 144/2 R; 100/144; 100/208; 100/272; 144/91; 144/347; 144/352; 144/85

[58] Field of Search ..... 100/144, 207, 208, 271, 100/272; 144/2 R, 90 R, 91, 346, 347, 352, 85

[56] References Cited

FOREIGN PATENT DOCUMENTS 2524100 12/1976 Fed. Rep. of Germany ..... 144/347
2543049 3/1977 Fed. Rep. of Germany ..... 144/347

*Primary Examiner*—W. Donald Bray
*Attorney, Agent, or Firm*—Robert W. Becker & Associates

[57] ABSTRACT

A dovetail jointing press for the manufacture of dovetail joints of boards, having respective dovetailings at their faces that are pasted with glue, is provided. The press comprises two tables that are disposed on common tracks and receive continuously fed boards. The tables are slidable on the tracks towards one another and away from one another via respective working cylinders. The respective presses that are disposed above each one of the tables are closed by working cylinders and released when the tables are moved away from one another. All the moving functions of the dovetail jointing press may be performed by working cylinders or by threaded spindles driven by electric motors. Computer programming may be used to coordinate the individual movements, so that the press may be operated automatically.

4 Claims, 2 Drawing Sheets

DOVETAIL JOINTING PRESS

BACKGROUND OF THE INVENTION

The present invention relates to a dovetail jointing press for the manufacture of dovetail joints (finger joints) of boards that at their faces or ends are provided with respective dovetailings (fingers) by a cutting tool whereby the dovetailings (fingers) are pasted with glue.

With dovetail cutting tools, the faces of boards that are stacked on edge are cut to yield dovetailings (fingers) of a length of 10 to 30 cm. The dovetailings (fingers) are subsequently pasted with glue. The faces of the boards are then joint one after another in dovetail joints, and the boards, in the same plane, are pressed against one another in a press until the glue hardens. Thus, endless boards are created that are composed of individual boards of various lengths. The pasting must have the same strength as the natural wood. The endless boards are then cut to length and the resulting boards are pasted and pressed to form laminated beams.

In conventional methods for a medium or high throughout, continuous presses are employed comprising an upper and a lower plate conveyer which transport the boards through the press in a frictionally connecting manner. Depending on the length of the dovetail (fingers), the pasting pressure must be in a range of 50 to 100 kg/cm$^2$, i.e., the feeding pressure is in the range from 5,000 to 10,000 kg for a common board cross-section of 25 cm by 4 cm. When per minute 10 or more joints are formed from boards of a length of 4 to 5 m, the energy requirements are high. At a feeding rate of 50 m per minute, 45 kW are needed for a press generating a pressure of 5,000 kg and 90 kW for a press generating a pressure of 10,000 kg. In addition to the very high energy requirements, the design of such presses is very complicated. With cycle presses, the holding pressure to be exerted for jointing the two boards generally must be double the feeding pressure.

It is therefore an object of the present invention to provide a dovetail jointing press that requires less energy, is of a simple design and reduces the amount of space required for set-up and operation.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The dovetail jointing press of the present invention is primarily characterized by two tables that are disposed on common tracks and receive continuously fed boards, whereby the tables are slidable on tracks towards one another and away from one another via respective working cylinders. Respective presses, that are disposed above each one of the tables for holding said boards, are provided whereby the presses are closed and released by the working cylinders and released when the tables are moved.

In a further embodiment, the presses are provided with a respective shaft which is arranged transverse to the transporting direction of the boards and is resting on a bridge and a press plate, whereby an upper corner of a triangle formed by levers and pull members are disposed at protruding ends of the shaft. The upper corner of the triangle is pivotable at a joint that is fixedly attached to the table and a lower corner of the triangle is connected via a further joint to pull rods that effect horizontal movement of the tables.

Another preferred embodiment provides pull rods that are connected to one another via the working cylinder that effects movement of the pull rods towards one another and away from one another.

Preferably, the tables, via the working cylinders, are commonly movable on the tracks during receiving of the boards in a direction against the transportation movement of the boards, and during a residing period with closed presses are movable in the direction of the transportation movement of the boards with the transportation speed of said boards.

With the inventive presses, all the requirements and conditions of the object of the present invention may be met. It is especially advantageous that the endless boards manufactured with these presses may be transported into the presses for the production of laminated beams after a relatively short residing period in the inventive press as compared to the conventionally required time of 8 to 24 hours.

Description of Preferred Embodiments

The present invention will now be described in detail with the aid of several specific embodiments utilizing FIGS. 1 through 5.

Figure 3:
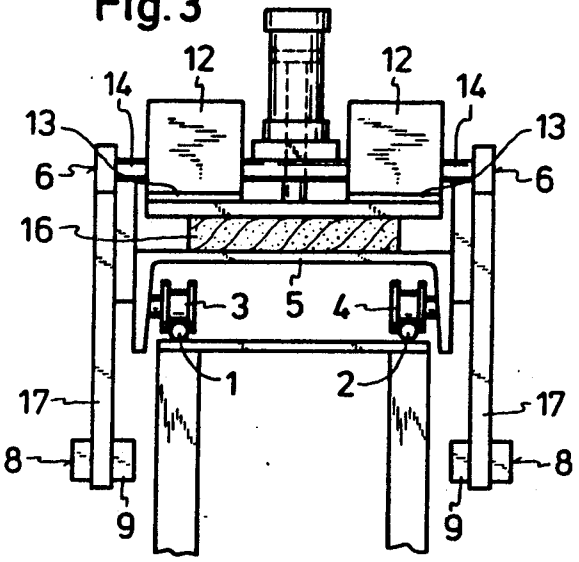
FIG. 3 is a cross-section of the press according to FIG. 1.
Figure 5:
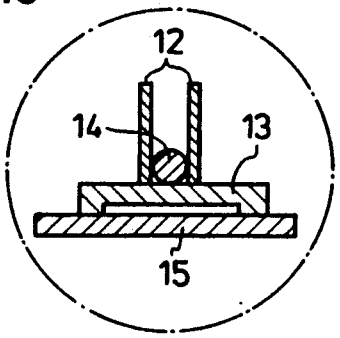
FIG. 5 is a part-sectional view of FIG. 2.
Figure 2:
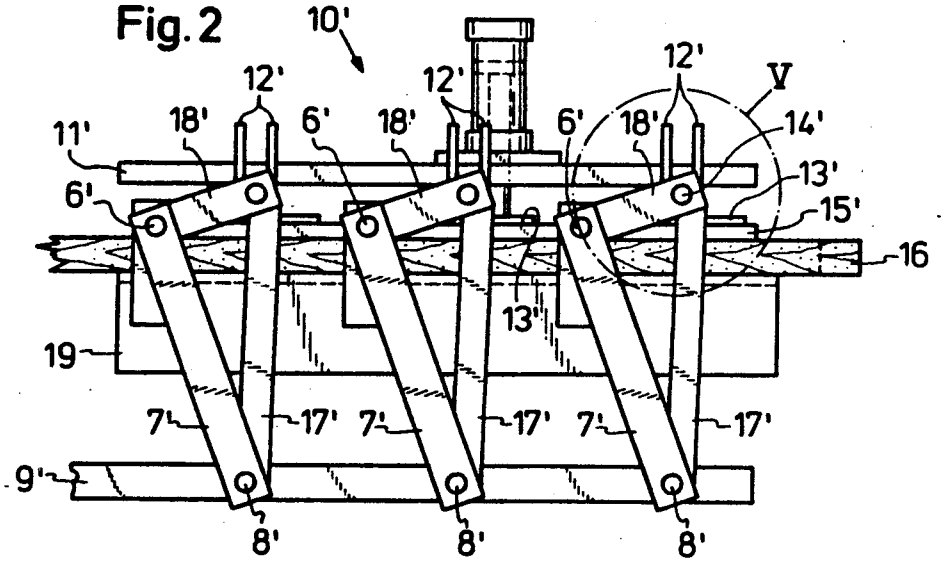
FIG. 2 is a part-sectional view of the representation of FIG. 1.
Figure 4:
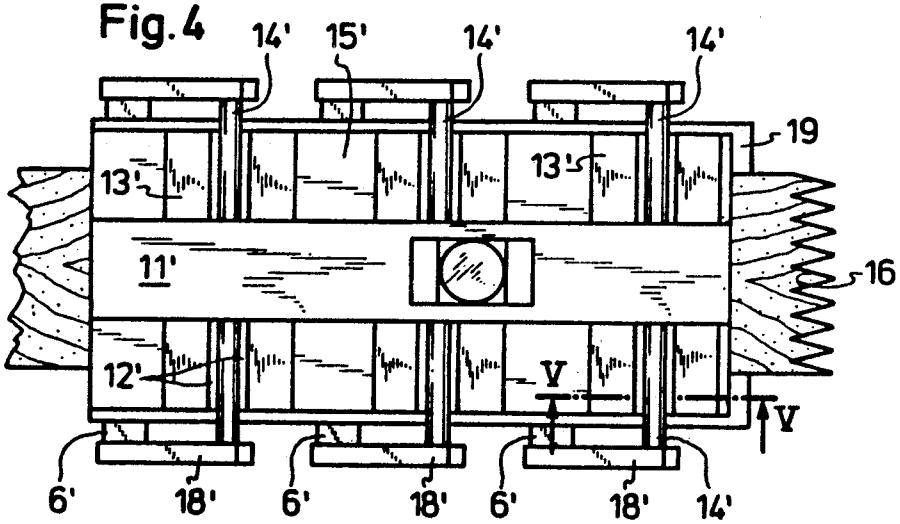
FIG. 4 is a part-sectional plan view of the press according to FIG. 1.

The dovetail jointing press represented in the accompanying drawings has a left table 5 (cf. FIG. 1) that is movable on the tracks 1 and 2 with the rollers 3 and 4 (FIG. 3). The table 5 is provided with joints 6 that are fixedly attached. The joints 6 are connected to levers 7 which at their lower end are connected in a force-locking manner to pull rods 9 via further joints 8. A press 10 arranged above the table 5 is equipped with a longitudinal support 11. To the underside of the support 11, a transverse track 12 is welded, which on its underside is provided with bridges 13 that extend transverse over the width of the table 5. Onto the bridges 13, shafts 14 are arranged in an area between the tracks 12. The bridges 13 are equipped with press plates 15 that are resting on the boards 16 to be pressed. The ends of the shaft 14 that are extending past the bridge 13, pull members 17 are attached the lower ends of which are connected, together with the levers 7, in joints 8 with the pull rods 9 in a force-locking manner. Between the upper ends of the pull members 17 and the levers 7 further levers 18 are arranged so that the levers 7, the pull members 17 and the further levers 18 from rigid triangles that are pivotable about the joints 6. The pull rods 9 act on the lower ends of the triangles thus raising or pressing down the shaft 14 by pivoting the triangles due to their horizontal movement The other side of the table 5 is provided with the same arrangement.

Figure 1:
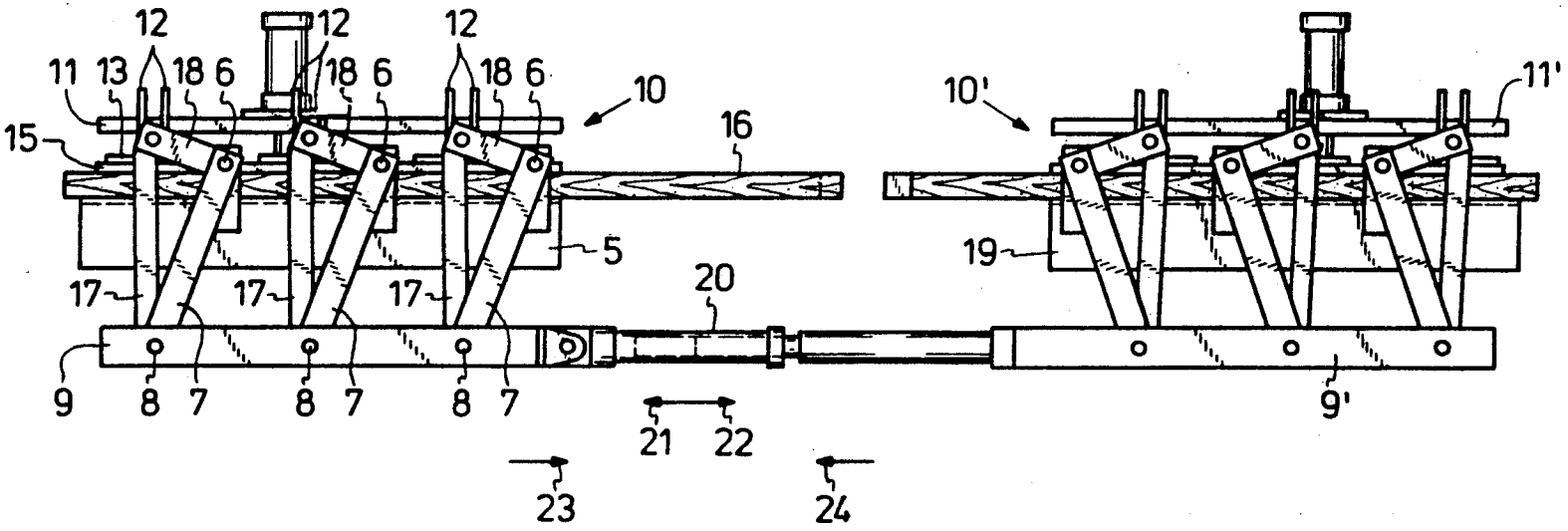
FIG. 1 is a schematic side view of a dovetail jointing press according to the present invention.

In FIG. 1, on the right hand side, a second table 19 is disposed on the tracks 1 and 2. The press 10' is arranged mirror-symmetrical to the press 10 of the table 5. Pull rods 9' are connected to the lower ends of the triangles 7', 17', 18'

The pull rods 9 and 9', between the tables 5 and 19, are connected via a working cylinder 20. The working cylinder 20 permits the movement of the pull rods 9, 9' towards one another or away from one another in their longitudinal direction, resulting in the described pivoting motion of the triangles.

The press of the present invention functions as follows: The tables 5 and 19 are moving on the tracks and 2 in a direction opposite the direction of transportation of the boards 16 (from the right to the left in FIG. 1) to receive the boards, which are coming from the dovetail cutting tool and are provided with dovetailings or fingers and pasted with glue, from a conveyer belt. The boards are moved onto the tables 5 and 19 for positioning under the presses 10, 10' such that one pair (or more) of board ends that are to be jointed are disposed under the press plate 15. The working cylinders 20 move the pull rods 9, 9' in the direction of the arrows 21, 22, thus pushing the tables 5, 19 away from one another. Simultaneously, the presses 10, 10' are raised due to the pivoting action of the triangles 7, 17, 18 in a clockwise direction and of the triangles 7', 17', 18' in a counter-clockwise direction so that the boards to be pressed may be introduced into the space below the presses 10, 10'. Then, the working cylinders 20 are actuated in the other direction so that the pull rods 9, 9' and the tables 5 and 19 are pulled towards each other in the direction of the arrows 23, 24 in FIG. 1 thus pressing the dovetail joints of the boards against one another. At the same time, the presses 10, 10' are closed due to the now oppositely directed pivoting movement of the triangles effected by the pulling action of the pull members 17 17'. The boards are thus tightly held while the respective dovetailings are pressed against one another and also during the short hardening period that follows. During this time, the tables 5 and 19, for a short distance, are rolling on the tracks 1 and 2 in the transportation direction of the boards 16. Then, due to the opening movement of the working cylinders in the direction of the arrows 21, 22 the pressure is released and the feeding of new boards 16 is enabled. The tables 5, 19 are rolling backwards, against the transportation direction of the boards 16, into their initial position. The described proceeding of closing and opening of the press is then repeated with new boards.

It is thus possible, with 5 pressings in one minute to joint 10 boards of a length of 5 m, whereby the energy required depending on the feeding rate of the boards (between 50 and 100 m/min), at a pressure of 5,000 kg is less than one tenth of the energy required with devices according to the prior art.

All the moving functions of the described dovetail jointing press may be performed by working cylinders or by threaded spindles driven by electric motors. Computer programming in order to coordinate the individual movements may be implemented easily thus permitting the automated operation of the complete process.

When leaving the dovetail jointing press, after being cut to length, the pressed boards may be transported on a conveyer belt, without being subjected to mechanical stress, to a press for producing laminated beams where the final hardening of the pasting may be achieved. The residing time in the dovetail jointing press is sufficient to ensure a strong enough jointing between the boards to permit their transport according to the above described method. Therefore, the requirements for storage and stacking space are significantly reduced.

The present invention is, of course, in no way restricted to the specific disclosure of the specification, examples and drawings, but also encompasses any modifications within the scope of the appended claims.

What I claim is:

1. A dovetail jointing press for manufacturing dovetail joints of boards that at end faces thereof are provided with respective dovetailings by a dovetail cutting tool and are pasted with glue, said dovetail jointing press further comprising:

two parallel, spaced apart tracks;

two tables, disposed opposite one another on said tracks, for receiving continuously fed boards, with said tables being slidable on said tracks towards one another and away from one another;

pull rods being connected in a pivotable manner to said tables on longer sides thereof;

at least one working cylinder connecting said pull rods of said oppositely disposed tables for sliding said tables on said tracks; and a respective press, disposed above each one of said tables, for pressing said boards onto said tables, said presses being drivingly connected to said working cylinders for closing and releasing said respective press.

2. A dovetail jointing press according to claim 1, wherein said press further comprises:

a support extending in a longitudinal direction of said tracks;

a plurality of transverse tracks connected to an underside of said support;

a plurality of shafts which are arranged transverse to a transporting direction of said boards;

a plurality of bridges arranged transverse to a transporting direction of said boards, whereby said shafts rest on said bridges between a respective pair of said transverse tracks;

a press plate connected to said bridges;

a plurality of first levers connected with a first end to respective protruding ends of said shafts and with a second end to said table;

a plurality of pull members connected with one end to said respective protruding ends of said shafts and with the other end connected to said pull rods;

a plurality of second levers being connected with one end to said pull rods together with said pull members and with the other end to said table together with said second end of said first levers; and respective ones of said pull members and said first and said second levers form a rigid triangle, with a first corner of said triangle being defined at said shaft, a second corner of said triangle being defined at said table, and with a third corner of said triangle being defined at said pull rod, said triangle being pivotable about said second corner.

3. A dovetail jointing press according to claim 1, wherein said tables are jointly movable on said tracks in a direction against said boards, and, during a residing period of said boards in said closed presses, are jointly movable in said direction of said transportation movement of said boards at a transportation speed of said boards.

4. A dovetail jointing press according to claim 2, wherein said presses of said tables are mirror-symmetrically arranged relative to one another.

* * * * *